US010436552B2

(12) United States Patent
Gray

(10) Patent No.: US 10,436,552 B2
(45) Date of Patent: Oct. 8, 2019

(54) DUAL COLOR LASER GUN SIGHT

(71) Applicant: Mark Gray, Wilmington, NC (US)

(72) Inventor: Mark Gray, Wilmington, NC (US)

( * ) Notice: Subject to any disclaimer, the term of this patent is extended or adjusted under 35 U.S.C. 154(b) by 0 days.

(21) Appl. No.: 15/717,867

(22) Filed: Sep. 27, 2017

(65) Prior Publication Data

US 2019/0093986 A1 Mar. 28, 2019

(51) Int. Cl.
*F41G 1/35* (2006.01)

(52) U.S. Cl.
CPC ..... *F41G 1/35* (2013.01)

(58) Field of Classification Search
CPC ..... F41G 1/35
USPC ..... 42/114
See application file for complete search history.

(56) References Cited

U.S. PATENT DOCUMENTS 8,186,093 B1 * 5/2012 Chung ..... F41G 1/35 42/113
8,459,822 B1 * 6/2013 Lambert ..... F41G 1/473 362/110
2011/0047851 A1 * 3/2011 Mock ..... F41C 23/16 42/72
2014/0007485 A1 * 1/2014 Castejon, Sr. ..... F41G 1/35 42/117
2017/0284769 A1 * 10/2017 Spielberger ..... F41C 33/0254

* cited by examiner

*Primary Examiner* — Stephen Johnson
*Assistant Examiner* — Benjamin S Gomberg
(74) *Attorney, Agent, or Firm* — James A. Italia; Italia IP

(57) ABSTRACT

A laser sight system for switching between one color of projected light, and a second color of projected light, depending upon ambient lighting levels. The system includes laser projectors of at least two colors, and optionally, a light level sensor having a setpoint and a setpoint adjuster. Actuation of an appropriate laser projector may be determined by sensing ambient light. The system may include a flashlight for general illumination, and a manual selector for selecting among three modes of operation. In one mode, only the laser projectors operate. In another mode, only the flashlight operates. In another mode, the lasers operate subject to the light level sensor, and the flashlight operates when the low light level laser is operating.

7 Claims, 1 Drawing Sheet

DUAL COLOR LASER GUN SIGHT

FIELD OF THE DISCLOSURE

The present disclosure relates to laser sights for projectors of projectiles, such as firearms.

BACKGROUND

Laser sights are frequently provided as part of devices such as firearms, to assist with aim. Laser sights have been provided in several varieties, such as those projecting red light and those projecting green light. Red laser light is easier to see under conditions of low or poor ambient light. By contrast, green laser light shows up better in well illuminated conditions.

In casual use, such as recreational shooting, a user can exchange laser types at his or her convenience. However, there are applications, such as military and police, wherein there may not be sufficient time to change to an appropriate laser light projector. In such situations, having an appropriate laser light projector may well be a matter of life and death.

There exists a need to be able to transition readily between lasers for bright ambient light conditions and low ambient light conditions.

SUMMARY

The disclosed concepts address the above stated situation by providing a laser sight system including two types of laser light projectors and optionally, automatic actuation of an appropriate one of the two. To this end, the present invention contemplates providing e.g. a red light laser, a green light laser, and optionally, a light level sensor adapted to selectively actuate the red and green light lasers. A light sensitivity control may be provided to personalize for each user the transition point from one laser color to the other.

Additionally, the novel laser sight system may include a white or visible light projector, hereinafter also referred to as a flashlight. A control may be provided to select among three operating modes. In one mode, only lasers operate, and may transition from one to the other depending upon ambient light levels. In another mode, the lasers and also the flashlight operate, with transition between the lasers also enabled. In a further mode, only the flashlight operates.

The novel laser light system may be implemented as an accessory installable on and removable from a firearm or other device, or alternatively, may be integrated into the firearm or other device.

BRIEF DESCRIPTION OF THE DRAWINGS

Various objects, features, and attendant advantages of the disclosed concepts will become more fully appreciated as the same becomes better understood when considered in conjunction with the accompanying drawings, in which like reference characters designate the same or similar parts throughout the several views, and wherein.

DETAILED DESCRIPTION

Figure 1:
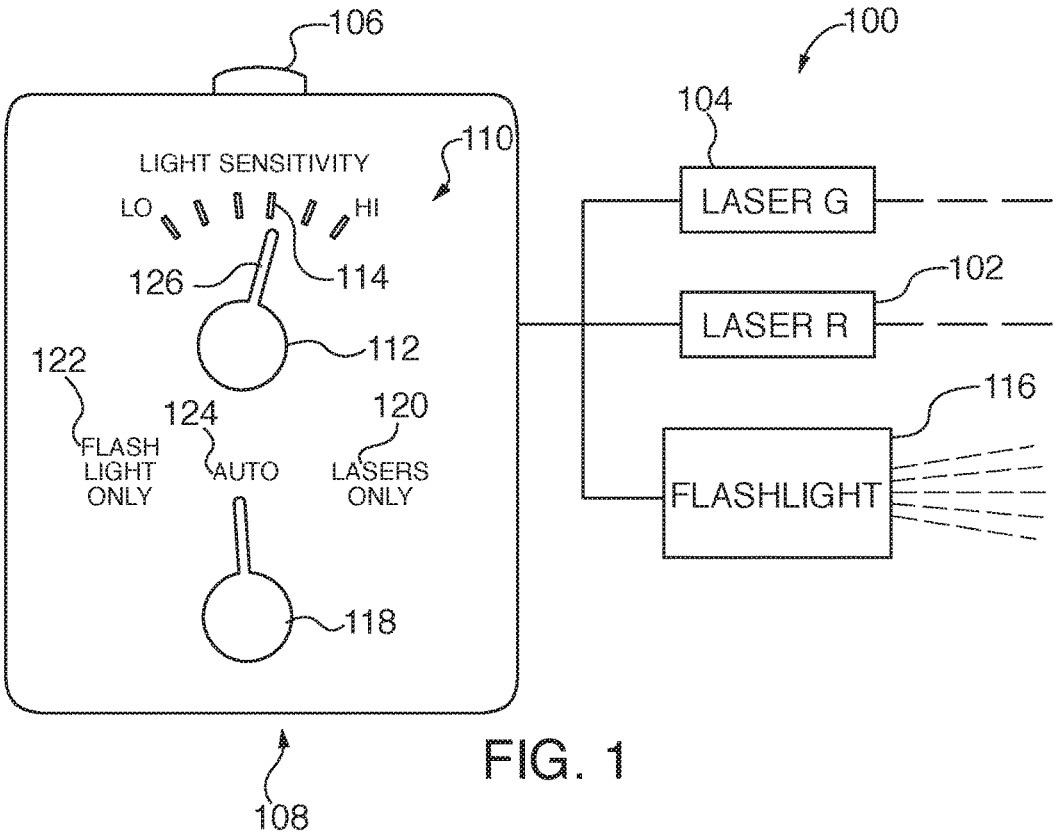
FIG. 1 is a diagrammatic illustration of components of the novel laser sight system, according to at least one aspect of the disclosure.

Referring first to FIG. 1, according to at least one aspect of the disclosure, there is shown components of a laser sight system 100 for aiming projectiles (not shown). Laser sight system 100 may comprise a first laser projector 102 including a laser of a first color (not separately shown), and a second laser projector 104 including a laser of a second color (not separately shown). The first color is relatively easily seen under low ambient light levels, and the second color is relatively easily seen under high ambient light levels.

Unless otherwise indicated, the terms "first", "second", etc., are used herein merely as labels, and are not intended to impose ordinal, positional, or hierarchical requirements on the times to which these terms refer. Moreover, reference to, e.g., a "second" item does not either require or preclude the existence of, e.g., a "first" or lower-numbered item, and/or, e.g., a "third" or higher-numbered item.

Laser light system 100 may further comprise a light level sensor 106 including a predetermined ambient light level setpoint, and a controller 108 configured to automatically actuate first laser projector 102 and inhibit second laser projector 104 when ambient light is below the predetermined ambient light level setpoint, and configured to actuate second laser projector 104 and inhibit first laser projector 102 when ambient light is above the predetermined ambient light level setpoint.

First and second laser projectors 102, 104 may be conventional in nature, and need not be set forth in greater detail herein. Light level sensor 106 may be of a type to generate an electrical signal usable in a control circuit. Controller 108 will be understood to include circuitry arranged to achieve functions described herein.

Laser sight system 100 may further comprise an ambient light level setpoint adjuster 110 configured to manually adjust the predetermined ambient light level setpoint. Ambient light level setpoint adjuster 110 may include a movable dial 112 and an array of indicator bars 114, the latter providing an index corresponding to setting of the setpoint.

Laser sight system 100 may further comprise a white light projector 116. First laser projector 102 may be interlocked with white light projector 116 such that when first laser projector 102 has been actuated, white light projector 116 is also actuated. Three modes of operation are contemplated, and may be invoked by a manual control (represented by dial 118).

In one mode of operation, only first and second laser projectors 102, 104 operate, and operation of flashlight 116 is inhibited. To this end, laser sight system 100 may further comprise manual control 118 inhibiting actuation of white light projector 116 when first laser projector 102 is actuated. To accomplish this, dial 118 would be set to a position corresponding to the legend "lasers only" 120.

In another mode of operation, when only use of flashlight 116 is desired, laser sight system 100 may further comprise a manual control actuating only white light projector or flashlight 116. As illustrated in FIG. 1, the manual control including dial 118 is a three position selector selecting among the two modes of operation described above and a third mode of operation, wherein first and second laser projectors 102, 104 both operate, subject to selection by light level sensor 106, and flashlight 116 also operates when first laser projector 102 has been actuated. The mode of use of only flashlight 116 may be invoked by moving dial 118 to the position of the legend "flashlight only" 122. Similarly, the third mode of operation may be invoked by moving dial 118 to the legend "auto" 124. Of course, dial position is determined by an indicating feature of dial 118, such as an arrow, by an audible signal, by an indicator light (none shown), or a pointer 126.

Although first and second laser projectors 102, 104 may be any desired color laser, in one implementation of laser light system 100, first laser projector 102 projects red laser light when actuated, and second laser projector 104 projects green laser light when actuated. These colors are deemed to be most effective in low ambient light levels and high ambient light levels, respectively.

Figure 2:
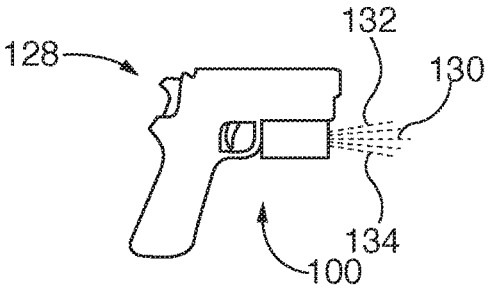
FIG. 2 is a diagrammatic side view of one implementation of the novel laser light system mounted to a firearm.

FIG. 2 shows laser sight system 100 coupled to a firearm such as handgun 128. First and second laser projectors 102, 104 flashlight 116 are not individually shown in FIG. 2, but are represented by respective symbolic projected light rays 130, 132, 134. Laser sight system 100 may also be used with rifles, shotguns, rocket propelled grenade launchers, bow and arrow, sling shot, or any other type of device for propelling a projectile (none shown).

Laser sight system 100 may be realized as a discrete component unto itself, or alternatively, may be integrated into its associated device for propelling a projectile. Regardless of its form and implementation, laser sight system 100 will be understood to be provided with suitable circuitry and power source (e.g., battery cells) necessary for operability, even if not shown herein.

While the disclosed concepts have been described in connection with what is considered the most practical and preferred implementation, it is to be understood that the disclosed concepts are not to be limited to the disclosed arrangements, but are intended to cover various arrangements which are included within the spirit and scope of the broadest possible interpretation of the appended claim so as to encompass all modifications and equivalent arrangements which are possible.

I claim:

1. A laser sight system for aiming projectiles, the laser sight system comprising:

a first laser projector including a laser of a first color;

a second laser projector including a laser of a second color;

a light level sensor including a predetermined ambient light level setpoint; and a controller automatically actuating the first laser projector and inhibiting the second laser projector in response to a signal from the light level sensor that ambient light is below the predetermined ambient light level setpoint, and actuating the second laser projector and inhibiting the first laser projector in response to a signal from the light level sensor that ambient light is above the predetermined ambient light level setpoint.

2. The laser sight system of claim 1, further comprising a white light projector, wherein the first laser projector is interlocked with the white light projector such that when the first laser projector has been actuated, the white light projector is also actuated.

3. The laser sight system of claim 2, further comprising a manual control configured to inhibit actuation of the white light projector when the first laser projector is actuated.

4. The laser sight system of claim 2, further comprising a manual control configured to actuate only the white light projector.

5. The laser sight system of claim 1, further comprising an ambient light level setpoint adjuster configured to manually adjust the predetermined ambient light level setpoint.

6. The laser sight system of claim 1, wherein the first laser projector projects red laser light when actuated.

7. The laser sight system of claim 1, wherein the second laser projector projects green laser light when actuated.

* * * * *